US009849689B1

(12) United States Patent
Gunnell et al.

(10) Patent No.: US 9,849,689 B1
(45) Date of Patent: Dec. 26, 2017

(54) WATER-VAPOR ASSIST FOR FILLING AQUEOUS PRINT HEADS

(71) Applicant: XEROX CORPORATION, Norwalk, CT (US)

(72) Inventors: Reid W. Gunnell, Wilsonville, OR (US); Nasser Alavizadeh, Tigard, OR (US); Douglas Dean Darling, Portland, OR (US); Walter Sean Harris, Portland, OR (US); Megan Schaffer, Hillsboro, OR (US); David L. Knierim, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/332,620

(22) Filed: Oct. 24, 2016

(51) Int. Cl.

| | |
|---|---|
| ***B41J 2/17*** | (2006.01) |
| ***B41J 2/175*** | (2006.01) |
| ***B41J 2/19*** | (2006.01) |
| ***B41J 2/18*** | (2006.01) |

(52) U.S. Cl.
CPC ..... *B41J 2/17596* (2013.01); *B41J 2/18* (2013.01); *B41J 2/19* (2013.01)

(58) Field of Classification Search
CPC . B41J 2/175; B41J 2/17556; B41J 2/18; B41J 2/19
USPC ..... 347/84, 85, 89, 92
See application file for complete search history.

(56) References Cited

U.S. PATENT DOCUMENTS 8,888,208 B2 * 11/2014 Cyman, Jr. ..... B41J 2/17596 347/6

* cited by examiner

*Primary Examiner* — An Do
(74) *Attorney, Agent, or Firm* — Marger Johnson

(57) ABSTRACT

A method of filling a print head includes drawing a vapor into an empty print head to displace any air in the print head and filling the print head with ink. A method of filling a print head includes connecting a print head to a vacuum pump using a first valve, to a liquid supply using a second valve, and to an ink supply using a third valve, opening the first and second valves, applying vacuum to the print head and liquid supply using the vacuum pump, causing the liquid to generate a vapor that moves into the print head, closing the first valve and the second valve, and opening the third valve to move ink into the print head.

8 Claims, 3 Drawing Sheets

WATER-VAPOR ASSIST FOR FILLING AQUEOUS PRINT HEADS

TECHNICAL FIELD

This disclosure relates to aqueous print heads, more particularly to the initial filling of the print head.

BACKGROUND

Printing systems typically include a print head, a supply of ink, a controller and associated electronics that guide the production of images from the ink onto print substrates. The print head may take many forms, including a jet stack, which is a series of thin, metal or polymer plates stacked together to form manifolds, pressure chambers, and an array of nozzles to deposit ink on the print substrates. Regardless of the configuration of the print head, it must undergo an initial fill.

The initial filling typically occurs at the manufacturing plant. A problem arises during the fill process because air, in the form of bubbles, becomes trapped in the print head. The presence of air bubbles interferes with the ability of the actuators to transmit pressure waves through the print head efficiently and reliably, where the pressure waves drive the ink out of the print head.

Historically, eliminating these bubbles involves a painful process of pushing large volumes of liquid through the print head. This typically dislodges large bubbles. Small bubbles become absorbed into the ink after a long process of patiently waiting. This can take several hours per print head.

SUMMARY

An embodiment is a method of filling a print head that includes drawing a vapor into an empty print head to displace any air in the print head and filling the print head with ink.

Another embodiment is a method of filling a print head that includes connecting a print head to a vacuum pump using a first valve, to a liquid supply using a second valve, and to an ink supply using a third valve, opening the first and second valves, applying vacuum to the print head and liquid supply using the vacuum pump, causing the liquid to generate a vapor that moves into the print head, closing the first valve and the second valve, and opening the third valve to move ink into the print head.

DETAILED DESCRIPTION OF THE EMBODIMENTS

Figure 1:
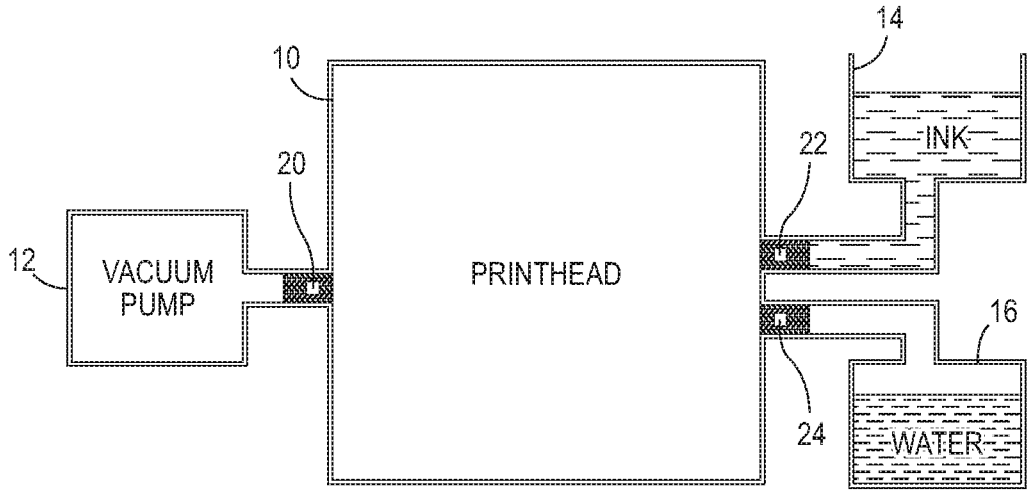
FIG. 1 shows an embodiment of an apparatus used to fill a print head with ink

FIG. 1 shows an embodiment of an apparatus used to fill a print head. The apparatus consists a vacuum pump 12 connected to the print head 10. An ink supply 14 connects through the print head to the vacuum pump, as does a liquid supply 16. In the examples shown here, the liquid consists of water, but may consist of other liquids discussed later. One should note that the ink fills the channel with no air leading into the print head. In contrast, a pocket of air or gas resides above the liquid in the liquid chamber.

The term 'ink' as used here comprises any liquid that is being jetted or deposited by the print head. It may consist of aqueous (water based ink), non-aqueous ink or any other jettable solution. Similarly, the term liquid may consist of any liquid, including water. Further, the 'liquid' supply may consist of a gas, and the liquid repository may be a gas chamber.

Figure 2:
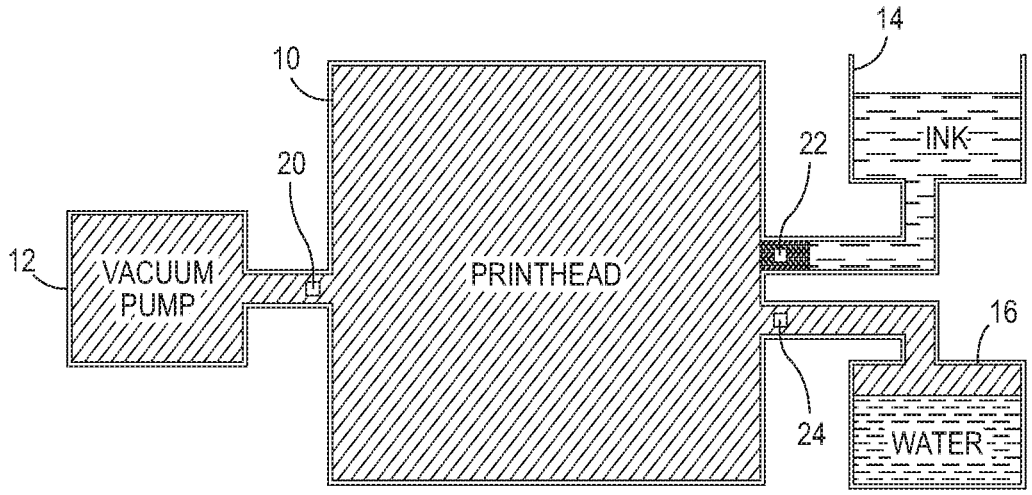
FIG. 2 shows an embodiment of an apparatus as a print head fills with vapor.

After connecting the print head to the vacuum pump, ink and liquid supplies, the valves 20 and 24 are opened and the vacuum pump 12 turns on. When the vacuum pump 12 lowers the pressure in the print head 10 and the liquid chamber 16 below the vapor pressure of the liquid, the liquid will begin to 'boil' and vapor from the liquid will be sucked into the print head as shown in FIG. 2.

The liquid vapor, in the example above, water vapor, displaces the vast majority of the air within the print head. The fill station continues in this state for a time to ensure maximum air displacement. Tests may be run to determine the necessary length of time to cause the vapor to displace the maximum amount of air based upon the pressure settings of the pumps.

Figure 3:
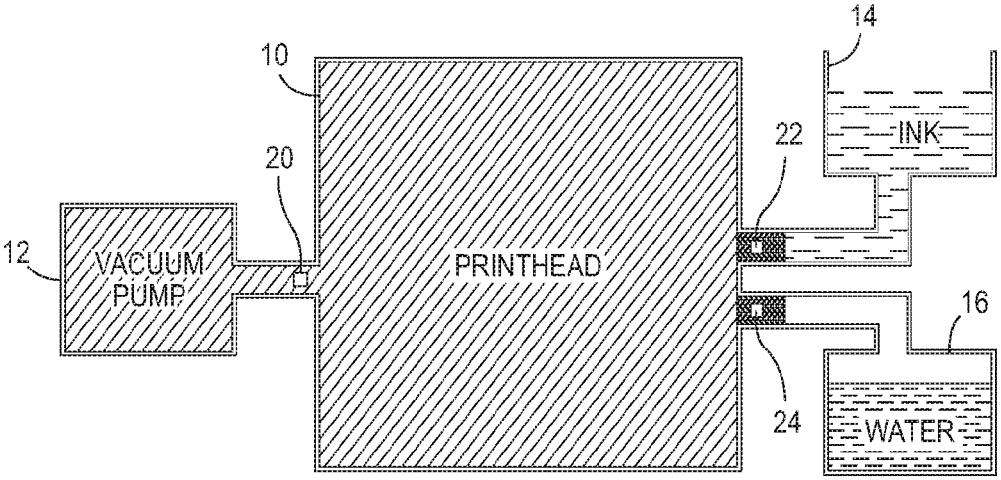
FIG. 3 shows an embodiment of an apparatus after a print head fills with vapor.

Once the print head has been substantially purged of air and filled with water vapor, valve 24 is closed, as shown in FIG. 3. When this valve closes, the boiling of the water ceases and the vacuum pump can a draw a deeper vacuum. The vapor pressure of the liquid in the supply 16 no longer limits the vacuum. Experiments have shown that it is possible to reach 0.5 Tor or lower in this portion of the process.

Figure 4:
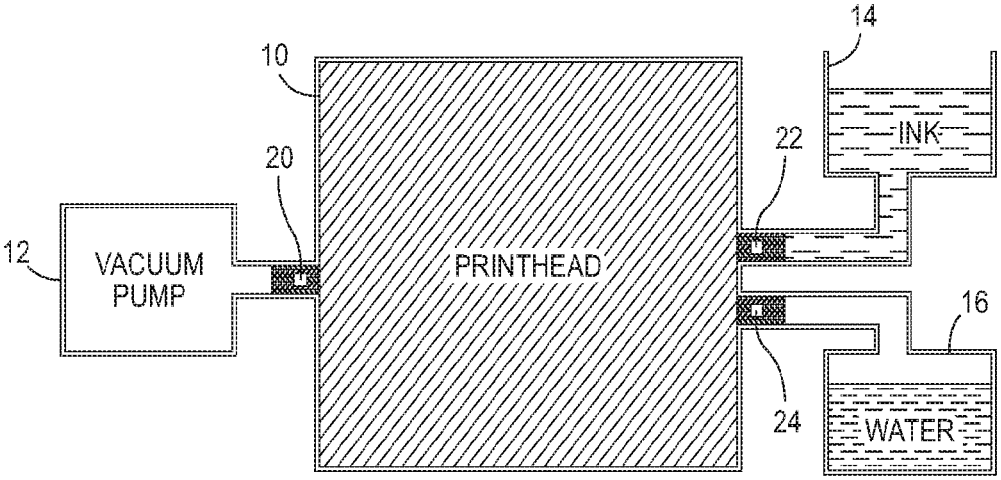
FIG. 4 shows an embodiment of an apparatus after a final vacuum has been reached.
Figure 5:
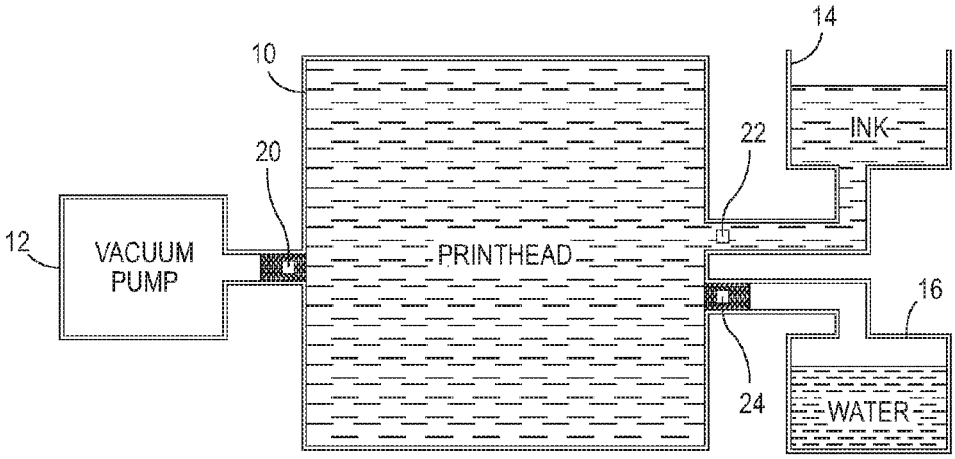
FIG. 5 shows an embodiment of an apparatus after an ink valve has been opened.
Figure 6:
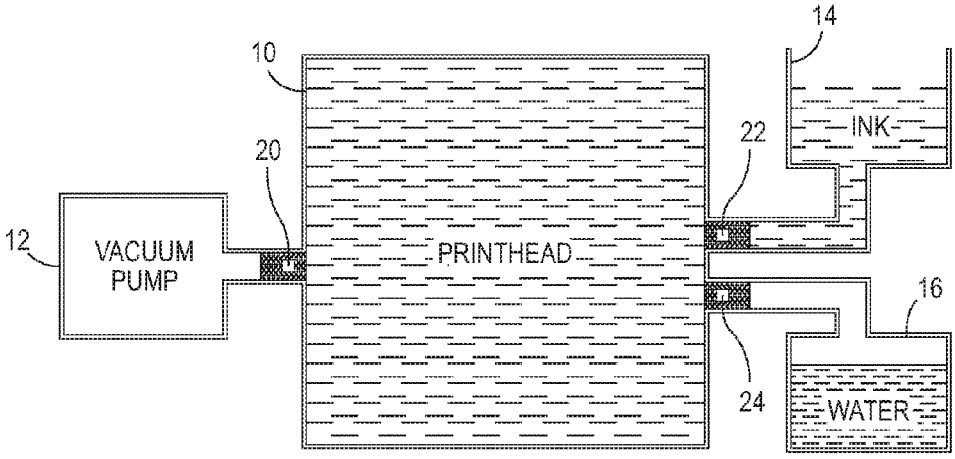
FIG. 6 shows an embodiment of an apparatus after a print head has been filled.

Once the final vacuum has been reached, valve 20 closes, as shown in FIG. 4. Valve 22 also opens, shown in FIG. 5. Because of the low pressure in the print head, the ink is sucked into the head. As the ink comes into the head, the vacuum level inside the print head returns to ambient pressure. When the vacuum level rises above the vapor pressure of the liquid, the vapor will condense into liquid and disperse into the ink. Once the filling of the head completes, valve 22 is closed, as shown in FIG. 6.

In this manner, once the fill of the print head is complete, there is a much reduced volume of gas in the print head. The fill process has much higher efficiency and takes much less time than previous processes.

Variations and modification exist for this process. For example, the fluid used may consist of water, as discussed above, or alcohol, or other fluids that are compatible with the inks being used in the print head. Alcohol provides an attractive alternative because it readily absorbs into water and has a low vapor pressure. This allows the alcohol to readily absorb into the aqueous ink. Another variation would be to perform the process inside a humidity chamber rather than using the vapor-creation of the vacuum pump. While this may be better than current practices, it may not be as advantageous as using a vacuum pump because the volume of air in the chamber that mixes with the vapor making it less efficient in the print head. Another variation would be to replace the chamber 16 liquid with a "gas chamber" containing a gas that is highly soluble in the ink to be used in the print head. The fundamental principle is to replace the air with a gas, of which water vapor is just an example, that can be readily absorbed into the ink being used within the print head.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of filling a print head, comprising:

connecting a print head which distributes ink through a jet stack and uses piezoelectric actuators to distribute ink onto a print substrate to a vacuum pump using a first valve, to a liquid supply which houses the liquid used for the vapor using a second valve, and to an ink reservoir using a third valve;

opening the first and second valves;

applying vacuum to the print head and liquid supply using the vacuum pump, causing the liquid to generate a vapor that moves into the print head;

closing the second valve, and using the pump to remove the vapor;

closing the first valve; and opening the third valve to move ink into the print head.

2. The method of claim 1, further comprising closing the second valve prior to closing the first valve.

3. The method of claim 2, wherein closing the second valve comprises closing the second valve for a predetermined amount of time prior to closing the first valve.

4. The method of claim 1, further comprising closing the third valve and disconnecting the print head from all the valves.

5. The method of claim 1, wherein connecting the print head to a liquid supply comprises connecting the print head to a water supply.

6. The method of claim 1, wherein connecting the print head to a liquid supply comprises connecting the print head to an alcohol supply.

7. The method of claim 1, wherein connecting the print head to a liquid supply comprises connecting the print head to a liquid supply, wherein the liquid is soluble to the ink.

8. The method of claim 1, wherein the liquid supply comprises a gas supply, wherein the gas is absorbable into the ink.

* * * * *